US005868223A

United States Patent [19]

Lubinski

[11] Patent Number: 5,868,223

[45] Date of Patent: Feb. 9, 1999

[54] FLANGE-TYPE SCAFFOLD JOINT ADAPTED TO RESIST LOOSENING OF WEDGE IN RESPONSE TO VIBRATION AND TAPPING

[76] Inventor: Ronald Lubinski, 40 Centenial Heights Court, Meaford, Ontario, Canada, N0H 1Y8

[21] Appl. No.: 481,405

[22] PCT Filed: Jul. 1, 1994

[86] PCT No.: PCT/CA94/00004

§ 371 Date: Jul. 10, 1995

§ 102(e) Date: Jul. 10, 1995

[87] PCT Pub. No.: WO94/16172

PCT Pub. Date: Jul. 21, 1994

[30] Foreign Application Priority Data

Aug. 1, 1993 [CA] Canada ..... 2086984

[51] Int. Cl.[6] ..... E04G 1/00

[52] U.S. Cl. ..... 182/179.1; 403/49; 403/217

[58] Field of Search ..... 182/179.1; 403/49, 403/217, 218

[56] References Cited

U.S. PATENT DOCUMENTS

| | | | |
|---|---|---|---|
| 4,083,640 | 4/1978 | Lovering | 182/179 X |
| 4,140,414 | 2/1979 | Buttgereit | 403/49 X |
| 4,576,500 | 3/1986 | Wong | 403/49 |

FOREIGN PATENT DOCUMENTS

| | | |
|---|---|---|
| 0276487 | 8/1988 | European Pat. Off. . |
| 0351703 | 1/1990 | European Pat. Off. . |
| 8501976 | 5/1985 | WIPO . |

*Primary Examiner*—Donald P. Walsh
*Assistant Examiner*—Emmanuel M. Marcelo
*Attorney, Agent, or Firm*—Mirek A. Waraksa

[57] ABSTRACT

A releasable joint connects an upright (10) and a transverse brace (16) in an aluminum scaffold frame. A horizontal aluminum flange (12) is attached to the upright (10) and an aluminum connector (18) to the brace (16). The connector (18) has a mouth (50) which receives the flange (12). A steel wedge (20) is inserted through a vertical passage (52) in the connector (18) and an opening (28) in the flange (12). The opening (28) contains a vertical, planar wedge-seating surface (36) of uniform horizontal cross-section. The connector (18) contains a pair of parallel, planar wedge-seating surfaces (54, 56), one above and one below the flange (12). These surfaces (54, 56) extend downwardly and radially outwardly relative to the upright (10) at a predetermined angle relative to vertical and have uniform horizontal cross-sections. The wedge (20) has a vertical edge surface (64) that mates with the wedge-seating surface (36) in the opening (28) and a pair of edge surfaces (66, 68) inclined at the predetermined angle and mated with the wedge-seating surfaces (54, 56) in the connector (18). The various mated surfaces slide relative to one another as the wedge (20) is forcefully inserted or released from the joint, reducing wear. The wedge (20) also forces the connector (18) downwardly against the flange (12), during wedge (20) insertion, ensuring that the joint is reliably locked.

5 Claims, 3 Drawing Sheets

FLANGE-TYPE SCAFFOLD JOINT ADAPTED TO RESIST LOOSENING OF WEDGE IN RESPONSE TO VIBRATION AND TAPPING

TECHNICAL FIELD

The invention relates generally to scaffold frames, and more specifically, to wedge-operated joints for joining components of a scaffold frame.

BACKGROUND ART

Uprights and transverse braces are principal components of a knock-down scaffold frame. A variety of releasable joints are known that permit the principal components to be joined to produce a unitary structure. The present invention has application to a wedge-operated joint whose general configuration has been widely accepted in the scaffold industry. The joint includes an annular horizontal flange which is fixed to an upright and which has a set of openings between its upper and lower faces. A complementary connector is fixed to the brace and has a mouth that receives the flange. A vertical passage in the connector is aligned with a flange opening, and a wedge is inserted through the aligned passage and flange opening to secure the joint. The wedge acts between the connector and the radial periphery of the flange to force the connector against the upright, locking the joint. Exemplary joints of this nature are shown in U.S. Pat. No. 4,044,523, No. 4,394,095, No. 4,426,171 and No. 4,603,756, all to Layher.

Inserting the wedge causes wear in the flange, the connector and the wedge itself. The wedge normally bears against a particular seating surface formed in the flange opening. In the prior Layher patents, the seating surface is rounded and the edge of the wedge that engages the seating surface is inclined relative to vertical. Since the wedge is driven vertically, it attacks the point of contact with considerable force, producing essentially a cutting action. Although the wedge is shaped to mate with vertical surfaces within the connector, at least when fully seated, similar point contacts may be formed as the wedge is driven to a final position or during initial stages of removal while the joint is stressed. The resulting wear may be gradual and tolerable in steel scaffold frames but it can quickly defeat the operation of an aluminum system. In that regard, it should be noted that steel wedges are still suggested for use in aluminum systems in order to withstand the hammering necessary to insert and remove the wedges.

Such scaffold joints also have a tendency to loosen and release. Wedging action inherently applies an upward force to the wedge. Point contacts between components may be inadequate to react such upward forces and avoid loosening of the wedge. Another significant aspect of this problem appears to have been overlooked. The connector normally rests on the upper surface of the flange when the joint is in a released state. As the wedge is driven downwardly, it not only forces the connector horizontally against the upright but also raises the connector until the latter engages the lower surface of the flange. Vibration, striking or other dynamic loads applied to the associated brace then cause the connector to dislodge, releasing the wedge and the joint. Moreover, a worker senses a significant resistance to wedge insertion when the connector engages the bottom surface of the flange. A worker tends to strike the wedge several more times assuming, incorrectly, that the wedge is just beginning to lock the joint. This encourages further damage to the components of the joint and is most significant if an aluminum flange is provided.

Alternative wedge-operated scaffold joints have been proposed but these also appear subject to the wear and loosening problems described above. U.S. Pat. No. 4,493,578 to D'Alessio proposes a wedge with one rounded side edge ostensibly conforming to vertically-aligned surfaces in the connector. The opposing side edge of the wedge and the corresponding seating surface within the associated flange opening are both angled relative to vertical, somewhat reducing wear. However, the angle between the side edges of the wedge does not conform to the inclination of the wedge-seating surface defined by the flange. Point contacts are formed, which contribute once again to wear. Furthermore, producing a wedge-seating surface that is not perpendicular to the customary flat upper surface of the flange adds complexity and increases manufacturing costs. In U.S. Pat. No. 4,840,513 to Hacket, point contacts are formed between the wedge, connector, and flange at various stages of wedge insertion and removal, once again leading to wear. In the scaffold joint described in U.S. Pat. No. 4,525,096 to Green et al, the wedge has one edge that aligns with a corresponding vertical wedge-seating surface within a flange opening, once the wedge is fully seated. However, the opposing side edge wedge is then angled relative to vertical and bears against vertical surfaces in the connector. One of the vertical connector surfaces is formed on an abutment element that displaces relative to the rest of the connector. Once again, point contacts are formed during wedge insertion and removal, which are expected to lead to wear.

DISCLOSURE OF THE INVENTION

In one aspect, the invention provides a releasable joint between an upright and a transverse brace in a scaffold frame. The joint includes an annular horizontal flange that extends radially from the upright. The flange has an upper face, a lower face, and an opening formed between radially inner and outer portions of the flange and extending between the flange faces. The radially outer flange portion defines a wedge-seating surface within the flange opening. The wedge-seating surface extends vertically between the flange faces and has a substantially uniform horizontal cross-section along a vertical axis.

A connector is attached to the brace. It comprises upper and lower connectors portions spaced to define a horizontal mouth that receives the flange. A passage extends through the upper and lower connector portions, intersecting the connector mouth, and is aligned with the flange opening. The connector has upper and lower wedge-seating surfaces located respectively within the upper and lower connector portions and positioned to a radially inner side of the passage. (Radial directions in this specification and the appended claims should be understood as relative to the upright.) The upper and lower wedge-seating surfaces are parallel and inclined downwardly and radially outwardly along axes inclined at a predetermined angle relative to vertical. Each has a substantially uniform horizontal cross-section along the associated axis.

A wedge is inserted through the connector passage. The wedge has a radially outer side edge that defines a vertical contact surface. The vertical contact surfaces has a substantially uniform horizontal cross-section along the vertical axis, which conforms to the horizontal cross-section of the wedge-seating surface of the flange. The vertical contact surface and the wedge-seating surface of the flange are mated along the vertical axis for relative sliding displacement along the vertical axis. The wedge has a radially inner side edge that defines upper and lower contact surfaces which are parallel. The upper contact surface has a substantially uniform horizontal cross-section along the first axis, which conforms to the horizontal cross-section of the upper wedge-seating surface, and is mated with the upper wedge-seating surface for relative sliding displacement along the first axis. The lower contact surface has a substantially uniform horizontal cross-section along the second axis, which conforms to the horizontal cross-section of the lower wedge-seating surface, and is mated with the lower wedge-seating surface along the second axis for relative sliding displacement along the second axis. A stop structure is attached to the upright and positioned to be engaged by the connector when the latter is displaced radially inwardly toward the upright.

When the wedge is driven vertically, the various pairs of mated surfaces slide relative to one another simultaneously along their associated axes. When viewed in vertical cross-section, the surfaces are contacted along a line rather than at a point. The tendency of the wedge to cut the flange or damage the connector is significantly reduced. The benefits are most pronounced when the flange is formed of an aluminum-containing material and the wedge is formed of a comparatively hard material, such as steel.

Another aspect of the joint should be noted. The wedge-seating surface in the flange is vertical. The wedge-seating surfaces in the connector are inclined downwardly and radially outwardly, effectively extending under the wedge at an angle relative to vertical. Thus, when the wedge is hammered downwardly to lock the joint, it urges the connector toward the upper surface of the flange. Once locked, the joint is stable and tends not to release unless the wedge is hammered from below.

Other aspects of the invention will be more apparent from a description below of a preferred embodiment and will be more specifically defined in the appended claims.

BRIEF DESCRIPTION OF THE DRAWINGS

The invention will be better understood with reference to drawings in which.

BEST MODE OF CARRYING OUT THE INVENTION

Figure 3:
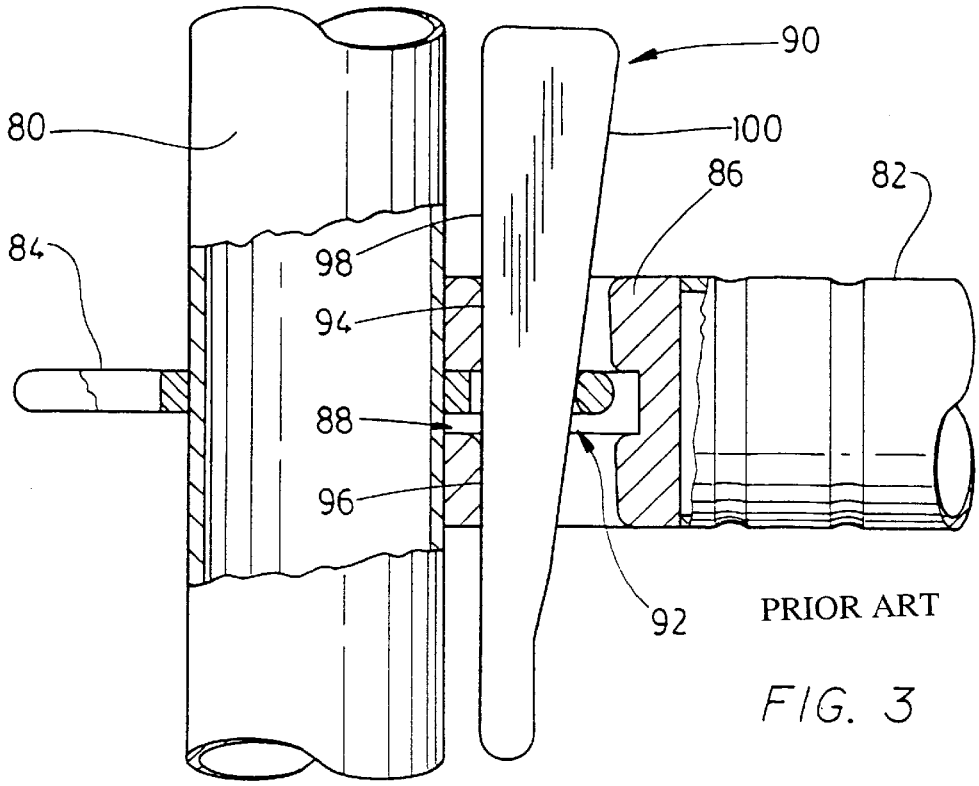
PRIOR ART FIG. 3
Figure 4:
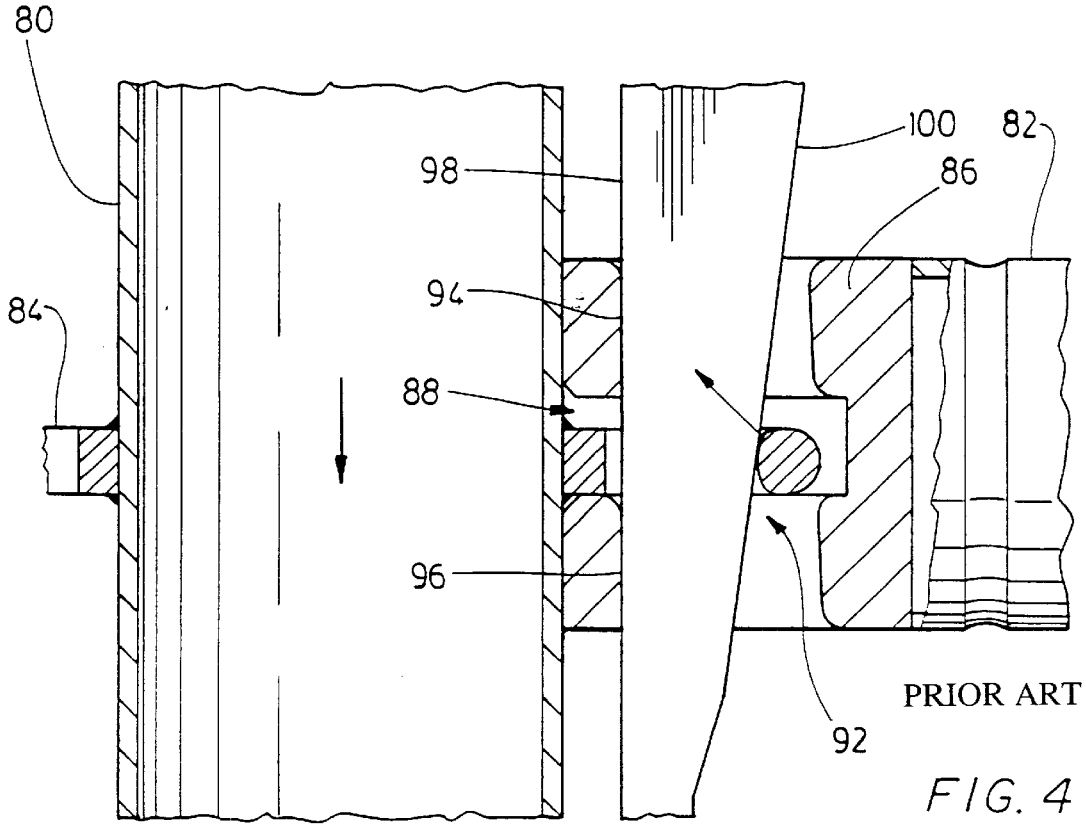
PRIOR ART FIG. 4

Reference is made to FIGS. 3 and 4 which show a prior art joint between an upright 80 and a horizontal brace 82 in a scaffold frame. The joint includes a circumferential flange 84 that is welded in a horizontal orientation to the upright 80. A connector 86 is attached to the brace 82 and has a mouth 88 that receives the flange 84. A wedge 90 inserts into a vertical passage (not numbered) in the connector 86 and an aligned opening 92 in the flange 84. The connector 86 has upper and lower wedge-seating surfaces 94, 96 that are vertical. These surfaces 94, 96 cooperate with a vertical contact surface 98 defined by a radially inner edge of the wedge 90. The wedge 90 has another contact surface 100 on its radially outer edge which is angled relative to vertical and engaged with a rounded surface at the opening 92.

It will be noted that the wedge 90 engages the flange 84 at an angle, which results in a cutting action as the wedge 90 is driven downwardly. Another problem with the prior art joint is highlighted in the two views. In FIG. 3, the joint is shown released with the connector 86 resting against the top of the flange 84. Although the wedge 90 is inserted, it has not yet be driven downwardly far enough to lock the joint and can be readily removed. As the wedge 90 is hammered downwardly, the connector 86 is compressed against the upright 80 and simultaneously forced upwardly until it contacts the bottom of the flange 84, substantially as shown in FIG. 4. The orientation of FIG. 4 is not very stable. The joint is able to withstand static loads applied to the brace 82, but tapping or vibration can dislodge the connector 86, causing it to drop to the upper surface of the flange 84. As the connector 86 drops, the wedge 90 is freed, releasing the joint. Although the wedge 90 is still present and will prevent the brace 82 from immediately disengaging from the flange 84, it will be apparent to those skilled in the art what hazard is posed if various joints in a large scaffold frame are released in this manner. Driving the wedge 90 an excessive distance through the flange 84 and the connector 86 might typically handle the problem. The resulting deformation of joint components may maintain a locked state but the deformation is permanent and repeated deformation causes the components to wear quickly. Steel wedges and flanges may endure such abuse for considerable time before requiring repair but flanges of aluminum-containing compositions will tend to fail more quickly.

Figure 1:
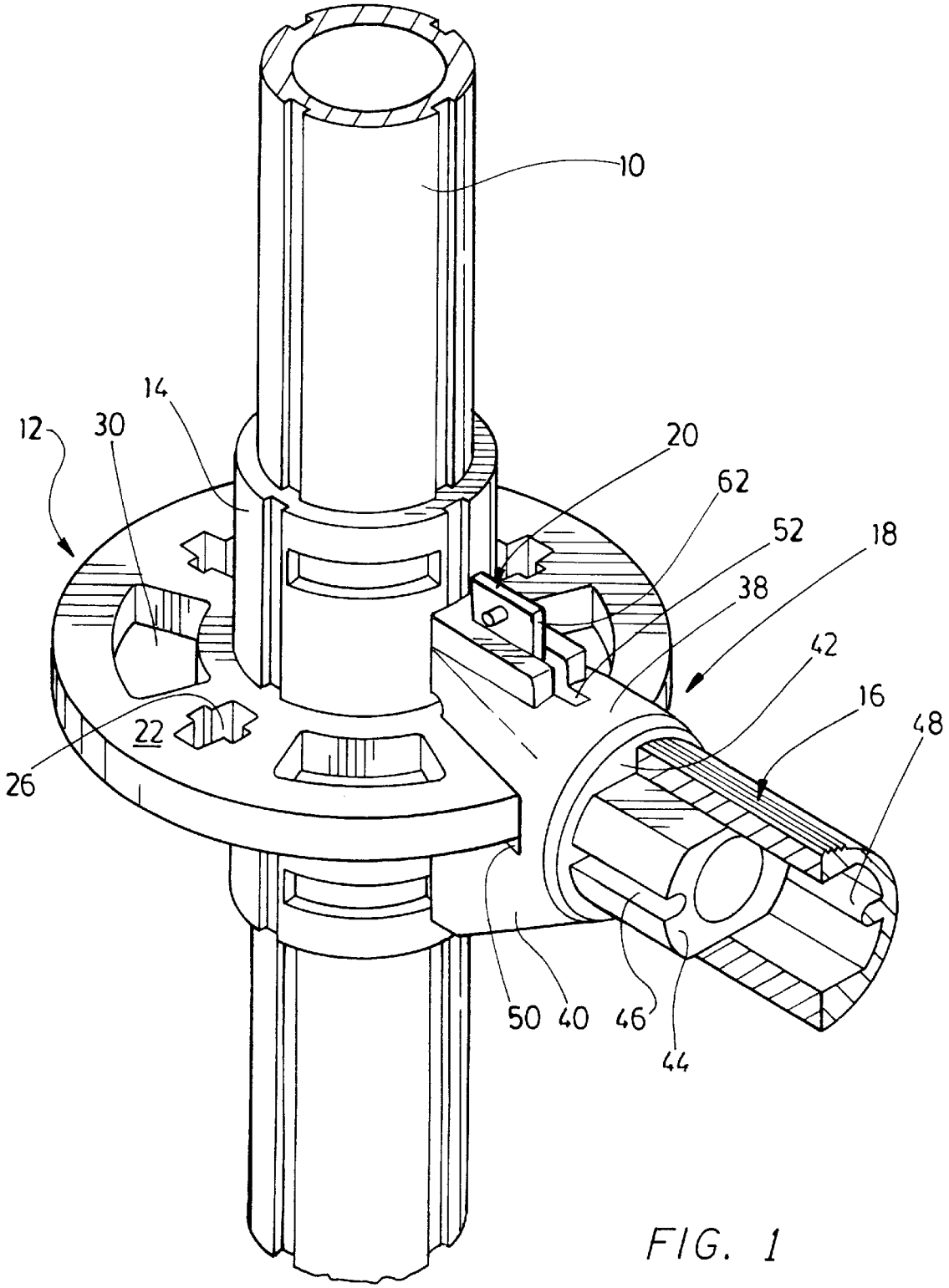
FIG. 1 is a fragmented perspective view of a releasable scaffold joint embodying the invention.

FIG. 1 shows components of a scaffold frame that are particularly pertinent to the present invention. These include an extruded upright 10 (extensively fragmented). An annular flange 12 is welded to an extruded mounting sleeve 14, and the assembly of sleeve 14 and flange 12 is then welded to the upright 10 with the flange 12 in a horizontal orientation. Alignment ribs and grooves (not indicated with reference numerals) are used to set the angular orientation of the flange 12 relative to the sleeve 14 and also the sleeve 14 relative to the upright 10 prior to welding, to position flange openings but such matters are not an aspect of the present invention. A tubular transverse brace 16 is secured to the flange 12 with a connector 18 and a wedge 20. The wedge 20 is formed of steel but the other components are relatively soft aluminum compositions, preferably compositions containing magnesium.

Figure 2:
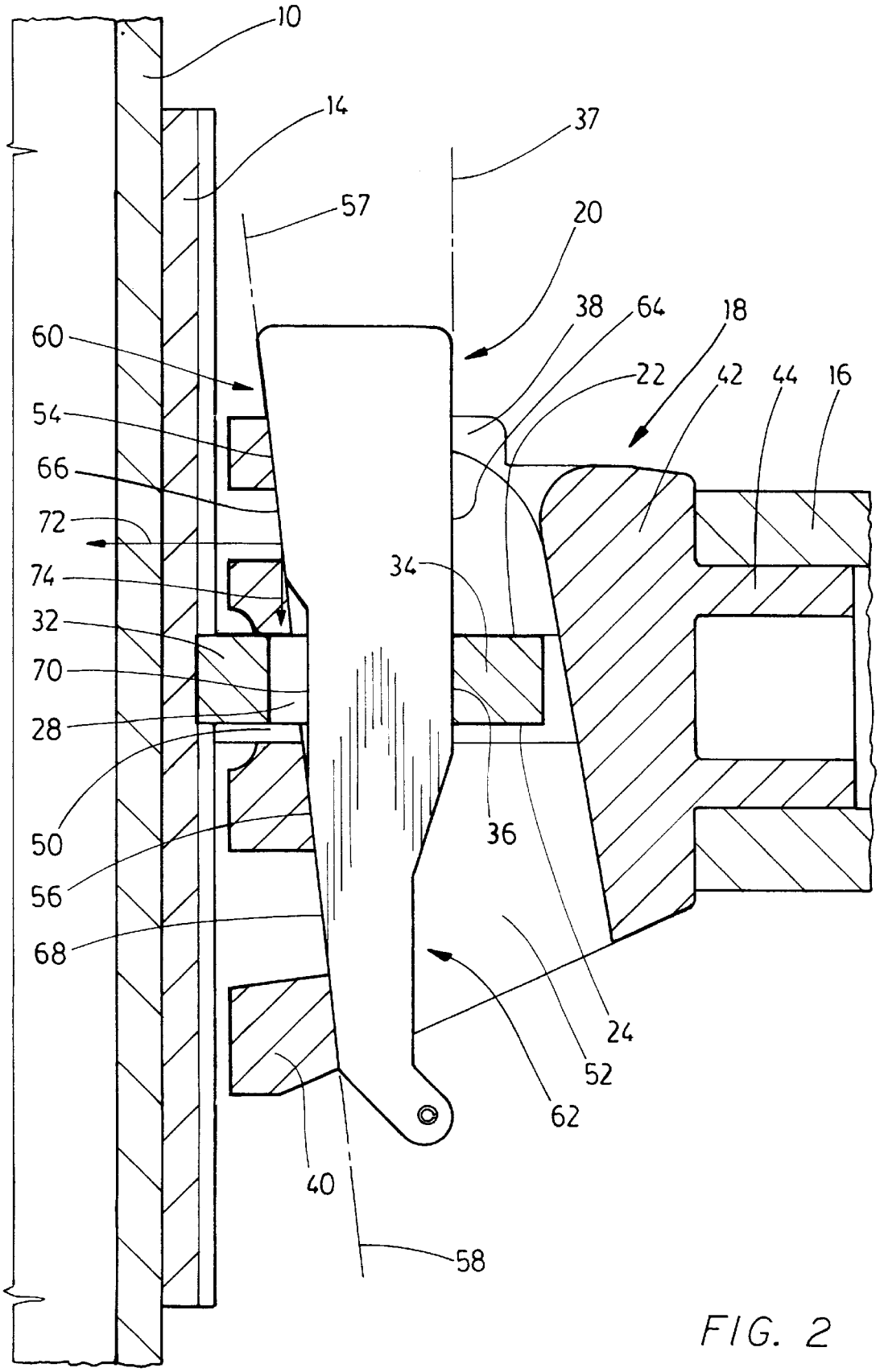
FIG. 2 is a fragmented cross-sectional view in a vertical plane providing further detail of the joint; and, FIGS. 3 and 4 are fragmented elevational views in partial cross-section showing a prior art scaffold joint respectively in released and locked states.

The flange 12 has upper and lower planar faces 22, 24. It is formed with two sets of four openings that extend between the flange faces 22, 24. One set of smaller openings is equally spaced by ninety-degrees. An opening 26 specifically indicated in FIG. 1 and another opening 28 specifically indicated in FIG. 2 are exemplary. This set of openings is intended to orient braces connected to the flange 12 at right angles to one another. Each opening of the other set (such as the exemplary opening 30 specifically identified in FIG. 1) has greater circumferential extent and permits braces to be oriented at various relative angles. Such matters are well known and will not be described further.

The configuration of the flange opening 28 and its relationship to the connector 18 and brace 16 are typical. The opening 28 is formed between radially inner and outer portions 32, 34 of the flange 12. It is preferable not to extend the opening 28 radially to the sleeve 14 as this weakens the flange 12 considerably. The radially outer flange portion 34 defines a planar wedge-seating surface 36 within the flange opening 28. That surface 36 extends between the flange faces 22, 24 and has a substantially uniform horizontal cross-section along a vertical axis 37.

The connector 18 is integrally cast. It has upper and lower connector portions 38, 40 that are rigidly fixed to one another through a circular base 42. A stem 44 extends from the base 42 into one end of the brace 16. The stem 44 is cast with a pair of longitudinal grooves (such as the groove 46) that interlock with a pair of ribs (such as the rib 48) extruded with the interior of the brace 16. This ensures that the connector 18 remains in a predetermined orientation relative to a corresponding connector (not illustrated) at an opposing end of the brace 16 to permit simultaneous joining of the brace 16 to two flanges on separate uprights. The connector 18 is welded (not shown) to the brace 16 in its set angular orientation. The stem 44 is significant as it better reacts shearing forces and torques arising at the joint.

The connector portions 38, 40 are vertically spaced to define a horizontal mouth 50 that receives the flange 12. A vertical passage 52 extends fully through the upper and lower connector portions 38, 40, intersecting the mouth 50. It is aligned with the flange opening 28 for receipt of the wedge 20. Both the passage 52 and flange opening 28 are dimensioned to loosely receive the wedge 20. The connector 18 has planar upper and lower wedge-seating surface 54, 56 (which are interrupted centrally by horizontal passages that allow debris from any stop engaged by the connector 18 to escape through the interior of the connector 18). The surfaces 54, 56 are formed in the connector passage 52 on its radially inner side. The upper and lower wedge-seating surfaces 54, 56 are parallel and extend downwardly and radially outwardly along parallel axes 57, 58 which are inclined at about 7 degrees relative to vertical. The axes 57, 58 are coincident but that is not strictly necessary for purposes of the invention. The surfaces 54, 56 have substantially uniform horizontal cross-sections along the axes 57, 58.

The wedge 20 tapers from top to bottom in overall configuration. It has radially inner and outer side edges 60, 62. The radially outer side edge 62 defines a vertical contact surface 64 that has a substantially uniform flat cross-section along the vertical axis 37 conforming to that of the vertical wedge-seating surface 36 of the flange 12. The radially inner side edge 60 defines upper and lower parallel, planar contact surfaces 66, 68 that are separated by an intermediate surface 70. The upper and lower contact surfaces 66, 68 are inclined at the same angle of 7 degrees relative to vertical as are the upper and lower wedge-seating surfaces 54, 56 of the connector 18. They have substantially uniform horizontal cross-sections conforming along the axes 57, 58 to the cross-sections of the wedge-seating surfaces 54, 56. The intermediate surface 70 is spaced radially outwardly from the inner flange portion 32 to avoid interference with wedging action. It is not necessary, however, to form an indented intermediate surface 70 if the opening 28 is radially dimensioned as shown. The upper and lower contact surfaces 54, 56 may in fact be part of a single flat edge surface.

In this embodiment, the sleeve 14 serves as a stop structure in general radial alignment with the flange opening 28. The connector 18 must be driven radially inwardly toward the sleeve 14 and compressed against the sleeve 14 to lock the joint properly. As in the prior art, tapping the wedge 20 downwardly through the passage drives the connector 18 against the stop structure. Tapping the wedge 20 upwardly releases the connector 18 from the stop structure. The connector 18 will normally be very close to the sleeve 14 even when the joint is released. The wedge 20 thus travels a short vertical distance (typically about 5 mm.) either to lock to or release the joint. Once the joint is released, the wedge 20 may be freely removed.

Three pairs of mated surfaces are present. A first pair consists of the vertical surfaces 36, 64 of the flange 12 and the wedge 20 which are mated along the axis 37. A second pair consists of the upper wedge-seating surface 54 of the connector 18 and the upper contact surface 66 of the wedge 20 which are mated along the axis 57. The third pair consists of the lower wedge-seating surface 56 of the connector 18 and the lower contact surface 68 of the wedge 20 which are mated along the axis 58. As the wedge 20 is driven vertically to and from the orientation of FIG. 2, the paired surfaces slide relative to one another along their respective axes 37, 57, 58. The parallel relationship between the second and third pairs of mated surfaces and their common angle relative to vertical preserves their mated relationships in response to vertical displacement of the wedge 20. Use of uniform, conforming cross-sections allows relative sliding along the axes 37, 57, 58.

The force applied to the connector 18 during insertion of the wedge 20 is shown diagrammatically in FIG. 2. It resolves into a horizontal component 72 that drives the connector 18 against the upright 10 and a downward vertical component 74 that drives the connector 18 against the upper face 22 of the flange 12. The downward component 74 is attributable to the inclination of the wedge-seating surfaces 54, 56 within the connector 18, downwardly and radially outwardly, and to the substantially vertical orientation of the wedge-seating surface 36 within the flange opening 28.

It will be appreciated that a particular embodiment of the invention has been illustrated and that various modifications may be made without necessarily departing from the scope of the appended claims. For example, planar seating and contacting surfaces are preferred for simplicity of manufacture. However, that is not critical to broader aspects of the invention. Mated surfaces need only have complementary horizontal cross-sections that are sufficiently uniform as to permit reliable sliding while mated.

I claim:

1. In a scaffold frame comprising a releasable joint between an upright and a transverse brace; the joint comprising a horizontal annular flange centered about and encircling the upright and extending radially from the upright, the flange comprising an upper face, a lower face and an opening located between radially inner and outer portions of the flange and extending between the faces; the joint further comprising a connector attached to the brace, the connector comprising upper and lower connector portions spaced to define a horizontal mouth that receives the flange, a passage extending through the upper and lower connector portions, intersecting the mouth and aligned with the opening; the joint further comprising a wedge inserted through the passage and the opening and removable upward through the passage; an improvement adapted to resist releasing of the wedge in an upward direction relative to the connector in response to vibration or tapping of the joint, in which:

the flange comprises a wedge-seating surface which is aligned with a vertical axis and has a uniform horizontal cross-section along the vertical axis, the wedge-seating surface defined in the opening of the flange by the radially outer flange portion and extending between the faces of the flange;

the connector comprises an upper wedge-seating surface located within the upper connector portion on a radially inner side of the passage, and a lower wedge-seating surface located within the lower connector portion on the radially inner side of the passage, the upper and lower wedge-seating surfaces of the connector are parallel, the upper wedge-seating surface extends downward and radially outward along a first axis inclined at a predetermined angle relative to the vertical axis and has a substantially uniform horizontal cross-section along the first axis, the lower wedge-seating surface extends downward and radially outward along a second axis inclined at the predetermined angle relative to the vertical axis and has a substantially uniform horizontal cross-section along the second axis; and, the wedge comprises a radially outer side edge defining a vertical contact surface extending along the vertical axis, the vertical contact surface has a substantially uniform horizontal cross-section along the vertical axis which conforms to the horizontal cross-section of the wedge-seating surface of the flange such that the vertical contact surface and the wedge-seating surface of the flange mate along the vertical axis for relative sliding displacement along the vertical axis; and, the wedge comprises a radially inner side edge defining an upper contact surface and a lower contact surface, the upper and lower contact surfaces extend downward and radially outward along the first and second axes respectively, the upper contact surface has a substantially uniform horizontal cross-section along the first axis which conforms to the horizontal cross-section of the upper wedge-seating surface such that the upper contact surfaces is mated along the first axis with the upper wedge-seating surface for relative sliding displacement along the first axis, the lower contact surface has a substantially uniform horizontal cross-section along the second axis which conforms to the horizontal cross-section of the lower wedge-seating surface such that the lower contact surface and the lower wedge-seating surface mate along the second axis for relative sliding displacement along the second axis;

whereby, during insertion of the wedge downward through the passage of the connector and the aligned opening of the flange, the wedge forces the connector downward until the upper connector portion seats on the upper face of the flange thereby preventing releasing of the wedge.

2. The scaffold frame of claim 1 in which the wedge-seating surface of the flange and each of the upper and lower wedge-seating surfaces of the connector are planar.

3. The scaffold frame of claim 2 in which the flange is formed of an aluminum-containing composition and the wedge is formed of steel.

4. The scaffold frame of claim 3 in which the connector is formed of an aluminum-containing composition.

5. The scaffold frame of claim 1 in which the first and second axes are coincident.

* * * * *